United States Patent [19]

Birke et al.

[11] 3,961,889

[45] June 8, 1976

[54] PROCESS AND AUXILIARY AGENT FOR IMPROVING THE WETTABILITY OF TEXTILE MATERIAL

[75] Inventors: Walter Birke; Hans-Ulrich von der Eltz; Franz Schön, all of Frankfurt am Main, Germany

[73] Assignee: Hoechst Aktiengesellschaft, Frankfurt am Main, Germany

[22] Filed: Dec. 5, 1974

[21] Appl. No.: 530,001

[30] Foreign Application Priority Data

Dec. 7, 1973 Germany ..... 2360985

[52] U.S. Cl. ..... 8/115.5; 8/54.2; 8/93 ; 8/127

[51] Int. Cl.[2] ..... D06P 1/68

[58] Field of Search ..... 8/93, 54.2, 127, 115.5

[56] References Cited

UNITED STATES PATENTS

| | | | |
|---|---|---|---|
| 2,635,942 | 4/1953 | Thummel | 8/93 |
| 3,844,711 | 10/1974 | Daeuble et al. | 8/93 |

*Primary Examiner*—V.P. Hoke

*Attorney, Agent, or Firm*—Curtis, Morris & Safford

[57] ABSTRACT

Process for improving the wettability of textile material by means of aqueous treating liquors containing 10 to 60 % by volume of a saturated aliphatic alcohol of up to 2 carbon atoms, or dyeing or finishing liquors containing these mixtures, which comprises adding to these mixtures at least another aliphatic, straight-chain or branched, monohydric alcohol having more than 2 carbon atoms.

19 Claims, No Drawings

PROCESS AND AUXILIARY AGENT FOR IMPROVING THE WETTABILITY OF TEXTILE MATERIAL

The present invention relates to a process and an auxiliary agent for improving the wettability of textile material.

It is widely known to use anionic, cationic and nonionic surface-active agents or mixtures thereof as wetting agents for the treatment of textile fibers with aqueous liquors of dyestuffs or finishing agents. Such agents reduce the surface tension of water and therefore improve the wettability of textile fibers. To promote these effects, use is also made of products to which emulsifiable organic solvents have been added. Such an addition of solvents may especially serve for a better fat or oil solubility of the aqueous media.

It is further known that mixtures of alcohol and water also improve the wettability of textile fibers. Thus, according to a burning off technique as disclosed in German Specifications Nos. 2,214,713 and 2,214,714 in which the preferably used alcohol is inflamed on the fiber to dry the material, the wetting effect obtained with this treating liquor is better than that obtained with pure water. The higher the alcohol content in the mixture with water, the lower its surface tension and the higher its wetting effect. For reasons of economy, however, the drying by said burning off technique is to be carried out with the lowest possible amount of solvent, although the wetting values, required for treating untreated or only unsatisfactorily pretreated textiles, would no longer be sufficient at such an amount. For such a mixture of water and methanol, the following values have been established:

TABLE I

| water % by volume | methanol % by volume | surface tension dyn/cm *) (1 dyn/cm = $1.10^{-5}$N/cm) | wetting time in seconds **) |
|---|---|---|---|
| 20 | 80 | 27 | 7 |
| 50 | 50 | 34 | 50 |
| 70 | 30 | 42 | 300 |

*) measured by means of the stalagmometer according to Traube (cf. K. Lindner, "Textilhilfsmittel und Waschrohstoffe", Wissenschaftliche Verlagsgesellschaft mbH., Stuttgart, W. Germany, 1954, pages 820 – 821)

**) measured according to the immersion wetting method (cf. K. Lindner, loc. cit., pages 827 – 829)

It has now been found that an addition of at least one aliphatic, straight-chain or branched alcohol having more than 2 carbon atoms to an aqueous treating liquor containing 10 to 60 % by volume, preferably 20 to 50 % by volume, of a saturated aliphatic alcohol having up to 2 carbon atoms, especially methanol, or to a dyeing or finishing liquor having such a mixture, reduces the surface tension of this mixture and therefore substantially improves its wetting effect on textiles. In particular, a substantial acceleration of the wetting of fibrous material is brought about according to the invention. Such a shortened wetting time is especially important and interesting for continuously operated treating methods which are run at elevated production speeds.

As aliphatic alcohols having more than 2 carbon atoms, there are mentioned according to the invention, above all, alcohols which are inflammable, for example propanol, isopropanol, butanol and isobutanol. These substances have the advantage that, in spite of this additive, the combustibility of the methanol/water mixtures, preferably used for economical reasons, on the fiber is not altered and that the products resulting from combustion do not pollute the waste air, so the flame-drying technique is still not detrimental to the environment. It is surprising and not at all obvious that butanol shows especially good effects despite its moderate solubility in water.

According to the invention, the alcohols having more than 2 carbon atoms are used in amounts of from 1 to 8 %, preferably 2 to 5 % by volume.

The effect of the alcohols, having more than 2 carbon atoms, used according to the process of the invention, can be increased substantially by further adding surface-active compounds. Such a mixture obviously brings about a synergistic effect which permits the use of considerably lower amounts of these two products (than in the case of the individual components) within the same wetting times as are usual in practice. This is particularly advantageous in the flame-drying method, since only a very small remnant of wetting agent is left on the goods.

As so-called surface-active substances, any known product of this type may be used, especially those of good biodegradability, respectively those which change their nature during the combustion process to such a degree that they do not pollute the waste water from the aftertreatment baths.

Surface-active substances to be used according to the invention are preferably aliphatic fatty alcohols in their oxethylated, oxypropylated and/or sulfonated form. For example, the reaction products of 1 mol of isotridecyl alcohol with 5 to 10 mols, preferably 8 mols, of ethylene oxide are especially suitable for this purpose.

The surface-active substances are used, according to the process of the invention, in amounts of from 0.1 to 3.0 g, preferably from 0.5 to 2.0 g, per liter of liquor used.

For the treatment according to the process of the invention, textile material made from all the known basic substances for natural or synthetic fibers or mixtures thereof may be used at any processing state which is suitable for a continuous operation.

This new combination of various alcohols, water and an optional small amount of a surface-active substance also allows, for example, textile articles made from raw cotton to be impregnated and rather regular effects to be obtained. Consequently, the economically reasonable flame-drying method can successfully be performed on insufficiently pretreated textiles, that is to say on textiles having a poor wettability, even if the content of inflammable solvents is low.

In comparison with treatment methods carried out without an addition of butanol and the above-cited surface-active oxyethylation product of isotridecyl alcohol, the process of the invention using these two substances ensures a substantial reduction in time for a satisfactory wetting of textiles with a mixture of methanol/water. It is this fact which makes the present invention so valuable and interesting, since a very special wetting agent is required to make it possible the short contact time of the liquor with the goods between the impregnation operation and the drying operation which leaves a residual moisture content of 0 to 15 % (below the migration threshold) in the scope of the flame-drying technique (on an average, 3 to 5 seconds as compared to 20 – 40 seconds with water).

In connection with this new process, the present invention also relates to an auxiliary agent for improving the wettability of textile material with aqueous treating liquors which may contain dyes and/or finishing agents, said agent consisting essentially of a mixture of a. saturated aliphatic alcohol having up to 2 carbon atoms, especially methanol, b. an aliphatic, straight-chain or branched, monohydric alcohol having more than two carbon atoms, especially propanol or butanol, and c. a surface-active oxethylation, oxypropylation and/or sulfonation product of aliphatic fatty alcohols, especially of the reaction product of 1 mol of isotridecyl alcohol with 5 to 10 mols, preferably 8 mols, of ethylene oxide.

This auxiliary mixture generally contains the separate constituents in the following amounts:

890 to 50 parts by volume of component (a),
100 to 700 parts by volume of component (b) and
10 to 250 parts by volume of component (c).

The mixing ratio of the separate substances in this auxiliary agent is preferably as follows:

650 to 120 parts by volume of component (a),
280 to 700 parts by volume of component (b) and
70 to 180 parts by volume of component (c).

Instead of the pure alcohol having up to 2 carbon atoms, component (a) may also be a mixture of 10 to 99 % by volume of a saturated, aliphatic alcohol of up to 2 carbon atoms, especially of methanol, and 90 to 1 % by volume of water.

In case a mixture of the alcohol having up to 2 carbon atoms and water is already present as the treating liquid within the limits required for the process of the invention, the auxiliary agent used has the following composition: 950 to 700, preferably 900 to 800, parts by volume of component (b) and 50 to 300, preferably 100 to 200, parts by volume of component (c).

The following Examples illustrate the invention, the percentage being by weight unless stated otherwise.

EXAMPLE 1

2.4 per cent of n-butanol were added to a solution of 70 % of water and 27.6 % of methanol. This mixture was used to determine the wetting time of a test cotton fabric according to the immersion wetting method (cf. K. Lindner, loc. cit.). The wetting time was 210 seconds, in comparison with more than 300 seconds, when wetting was performed without the addition of butanol.

EXAMPLE 2

Using a solution of 70 % of water, 27 % of methanol and 3 % of n-butanol, a wetting time of 5 seconds and a surface tension of 38 dyn/cm (according to Traube) were determined. Compared to the values obtained in Example 1, this means a particularly marked improvement as to the wetting effect.

The addition of about 5 % of n-butanol reduced the wetting time to about 1 second. The surface tension remained the same at 38 dyn/cm (corresponding to $38.10^{-5}$N/cm).

EXAMPLE 3

7 per cent of isobutanol were added to 70 % of water and 23 % of methanol. The wetting time was 1.5 seconds.

EXAMPLE 4

The wetting effect of the reaction product of 1 mol of isotridecyl alcohol with 8 mols of ethylene oxide in water could be improved by adding n-butanol. The same effect can also be demonstrated on mixtures of methanol/water, in which the methanol content is relatively low. The results are listed in the following Table II:

TABLE II

| | Solution of % of water | % of methanol | % of butanol | g/l of wetting agent | wetting time in seconds |
|---|---|---|---|---|---|
| a | 100 | — | — | 0.2 | 163 |
| 1 b | 100 | — | — | 0.4 | 98 |
| c | 100 | — | — | 1.0 | 15 |
| a | 97.5 | — | 2.5 | 0.2 | 86 |
| 2 b | 97.5 | — | 2.5 | 0.4 | 38 |
| c | 97.5 | — | 2.5 | 1.0 | 4 |
| a | 70 | 30 | — | 0.2 | 142 |
| 3 b | 70 | 30 | — | 0.4 | 40 |
| c | 70 | 30 | — | 1.0 | 6 |
| a | 70 | 27.5 | 2.5 | 0.2 | 18 |
| 4 b | 70 | 27.5 | 2.5 | 0.4 | 7 |
| c | 70 | 27.5 | 2.5 | 1.0 | 1 |

We claim:

1. In a process for wetting a textile material by aqueous treating liquors containing 10 to 60% by volume of a saturated aliphatic alcohol of up to 2 carbon atoms, or dyeing or finishing liquors containing such a mixture, the improvement which comprises adding to said mixture, in an amount of 1 to 8% by volume, an aliphatic, straight-chain or branched, monohydric alcohol of more than 2 carbon atoms.

2. The process as defined in claim 1, wherein the alcohol of more than 2 carbon atoms is propanol, isopropanol, butanol or isobutanol.

3. The process as defined in claim 1, wherein the alcohol of more than 2 carbon atoms is added in an amount of 2 to 5% by volume.

4. The process as defined in claim 1, wherein a surface-active substance is added.

5. The process as defined in claim 4, wherein the surface-active substance is an oxyethylation, oxypropylation or sulfonation product of an aliphatic fatty alcohol or a mixture thereof.

6. The process as defined in claim 5, wherein the surface-active substance is the reaction product of 1 mol of isotridecyl alcohol with 5 to 10 mols of ethylene oxide.

7. The process as defined in claim 4, wherein the surface-active substance is used in an amount of 0.1 to 3.0 g/l.

8. The process as defined in claim 1, wherein an article made from raw cotton is treated as the textile material.

9. An auxiliary agent for improving the wettability of a textile material, said agent consisting essentially of a mixture of a. a saturated aliphatic alcohol of up to 2 carbon atoms or a mixture of 10 to 99% by volume of said alcohol with 90 to 1% by volume water, b. an aliphatic, straight-chain or branched, monohydric alcohol of more than 2 carbon atoms, and c. a surface-active oxyethylation, oxypropylation or sulfonation product of an aliphatic fatty alcohol or a mixture thereof.

10. An auxiliary agent as defined in claim 9, which consists essentially of a mixture of 890 to 50 parts by volume of component (a),
100 to 700 parts by volume of component (b) and
10 to 250 parts by volume of component (c).

11. An auxiliary agent as defined in claim 10, which consists essentially of a mixture of 650 to 120 parts by volume of component (a),
280 to 700 parts by volume of component (b), and
70 to 180 parts by volume of component (c).

12. An auxiliary agent as defined in claim 9, wherein component (a) is a mixture of 10 to 99% by volume of saturated, aliphatic alcohol of up to 2 carbon atoms and 90 to 1% by volume of water.

13. The process as defined in claim 4, wherein a mixture of 950 to 700 parts by volume of the alcohol of more than 2 carbon atoms and 50 to 300 parts by volume of the surface-active substance is added.

14. The process as defined in claim 13, wherein a mixture of 900 to 800 parts by volume of the alcohol of more than 2 carbon atoms and 100 to 200 parts by volume of the surface-active substance is added.

15. The auxiliary agent as defined in claim 9, wherein the alcohol of up to 2 carbon atoms is methanol.

16. The auxiliary agent as defined in claim 9, wherein the alcohol of more than 2 carbon atoms is propanol.

17. The auxiliary agent as defined in claim 9, wherein the alcohol of more than 2 carbon atoms is butanol.

18. The auxiliary agent as defined in claim 9, wherein the surface-active product is the reaction product of 1 mol of isotridecyl alcohol with 5 to 10 mols of ethylene oxide.

19. The process as defined in claim 2, wherein the alcohol of more than 2 carbon atoms is butanol.

* * * * *